US010801502B2

(12) United States Patent
Brunvold et al.

(10) Patent No.: US 10,801,502 B2
(45) Date of Patent: Oct. 13, 2020

(54) FLUID PROCESSING MACHINES AND FLUID PRODUCTION SYSTEMS

(71) Applicant: OneSubsea IP UK Limited, London (GB)

(72) Inventors: Anders Brunvold, Blomsterdalen (NO); Wiggo Silden, Nesttun (NO); Daniel Tonning, Laksevag (NO)

(73) Assignee: OneSubsea IP UK Limited, London (GB)

( * ) Notice: Subject to any disclaimer, the term of this patent is extended or adjusted under 35 U.S.C. 154(b) by 319 days.

(21) Appl. No.: 15/746,633

(22) PCT Filed: Aug. 8, 2016

(86) PCT No.: PCT/EP2016/068851
§ 371 (c)(1),
(2) Date: Jan. 22, 2018

(87) PCT Pub. No.: WO2017/021553
PCT Pub. Date: Feb. 9, 2017

(65) Prior Publication Data

US 2018/0223854 A1 Aug. 9, 2018

Related U.S. Application Data

(60) Provisional application No. 62/201,933, filed on Aug. 6, 2015.

(51) Int. Cl.
*F04D 13/08* (2006.01)
*F04D 19/02* (2006.01)
(Continued)

(52) U.S. Cl.
CPC ..... *F04D 13/086* (2013.01); *E21B 43/128* (2013.01); *F04D 1/003* (2013.01);
(Continued)

(58) Field of Classification Search
CPC ..... F04D 1/06; F04D 13/086; F04D 19/02; F04D 19/024; F04D 19/026;
(Continued)

(56) References Cited

U.S. PATENT DOCUMENTS 5,547,350 A 8/1996 Rawal et al.
5,713,727 A 2/1998 Veronesi et al.
(Continued)

FOREIGN PATENT DOCUMENTS

EP 2824330 A1 1/2015
WO WO-2010014640 A2 * 2/2010 ..... H02K 5/1285
WO 2015114136 A1 8/2015

OTHER PUBLICATIONS

International Search Report and Written Opinion issued in International Patent Appl. No. PCT/EP2016/068851 dated Oct. 7, 2016; 11 pages.
(Continued)

*Primary Examiner* — Kenneth J Hansen
(74) *Attorney, Agent, or Firm* — Helene Raybaud

(57) ABSTRACT

A fluid processing machine that includes a stator capable of generating an electromagnetic field and a first rotor section having at least one impeller and at least one permanent magnet. The stator is configured to electromagnetically engage with the first rotor section so as to rotate the first rotor section about a central axis in a first rotational direction. Further rotor sections can also be included that are induced to rotate in the first rotational direction. Other rotator sections with impellers and permanent magnets can also be included that are driven in a second, contra-rotating, direction by a second stator. Several of the fluid processing machine can be distributed within a surface system or subsea system that transports produced fluid from wells to a surface facility.

21 Claims, 10 Drawing Sheets

(51) Int. Cl.

| | |
|---|---|
| ***F04D 25/06*** | (2006.01) |
| ***F04D 13/06*** | (2006.01) |
| ***F04D 1/06*** | (2006.01) |
| ***F04D 17/12*** | (2006.01) |
| ***E21B 43/12*** | (2006.01) |
| ***F04D 1/00*** | (2006.01) |
| ***F04D 29/041*** | (2006.01) |

(52) U.S. Cl.
CPC ..... *F04D 1/06* (2013.01); *F04D 1/066* (2013.01); *F04D 13/06* (2013.01); *F04D 17/125* (2013.01); *F04D 19/026* (2013.01); *F04D 25/0606* (2013.01); *F04D 25/0686* (2013.01); *F04D 29/041* (2013.01)

(58) Field of Classification Search
CPC ..... F04D 19/028; F04D 17/12; F04D 17/125; F04D 25/0606; F04D 25/0696; F04D 29/048; F04D 29/286; F04D 29/52; F04D 29/32; F04D 31/00
See application file for complete search history.

(56) References Cited

U.S. PATENT DOCUMENTS

| | | | | |
|---|---|---|---|---|
| 2002/0066568 | A1 | 6/2002 | Buchanan et al. | |
| 2004/0134662 | A1* | 7/2004 | Chitwood | E21B 4/04 166/367 |
| 2006/0251513 | A1 | 11/2006 | Kalavsky et al. | |
| 2010/0272591 | A1 | 10/2010 | Kjaer et al. | |
| 2011/0116947 | A1 | 5/2011 | Yi et al. | |
| 2013/0236341 | A1 | 9/2013 | Andersen | |
| 2013/0343932 | A1* | 12/2013 | Stinessen | F04D 25/0686 417/410.1 |
| 2015/0377358 | A1* | 12/2015 | Groette | F16J 15/3404 415/1 |
| 2017/0159665 | A1* | 6/2017 | Bergamini | F04D 19/024 |

OTHER PUBLICATIONS

Examination issued in European Patent Appl. No. 16754454.3 dated Mar. 20, 2020; 5 pages.

* cited by examiner

FLUID PROCESSING MACHINES AND FLUID PRODUCTION SYSTEMS

CROSS-REFERENCE TO RELATED APPLICATIONS

This patent application claims the benefit of U.S. Prov. Ser. No. 62/201,433 filed Aug. 6, 2015 and incorporated by reference herein.

TECHNICAL FIELD

The present disclosure relates to fluid processing machines. More particularly, the present disclosure relates to fluid processing machines comprising impellers with permanent magnets.

BACKGROUND

An impeller is a rotating component of a rotating machine like, for example, a pump or a compressor, whether this machine is for single or multi-phase fluid. A motor source drives the impeller(s), and the impellers transfer energy to the fluid being pumped. In an example pump, the impellers might be stacked up with an interim diffusor stage in between. The diffusor stage has an increasing flow area and transforms the fluid kinetic energy into fluid pressure. For a contra-rotating compressor or pump, diffusor stages might not be needed. In some contra-rotating embodiments, the opposite rotation of adjacent impeller stages might transform portions of the kinetic energy into next-level increased pressure energy. In order to raise performance, i.e. large capacity, high pressure increase, and good efficiency, the operating envelope of a rotating machine might be optimized. Such optimization might comprise minimizing pressure loads, avoiding undesirable flow regime.

Conventional electrically powered rotating fluid processing machines such as pumps and compressors mount the impellers on the outer surface of a long central shaft that is rotated by an electric motor. The electric motor is therefore longitudinally offset from the impellers by an axial distance, and the overall length of the combined motor and pump or compressor section is likewise quite long. In many applications, such as subsea fluid processing, the size, weight and length of the entire system including the shaft and electric motor are all important factors for the overall system deployment cost as well as for the locations where the fluid processing equipment can be deployed. Furthermore, due to the shaft occupying the central portion of the impeller section, conventional fluid processing machines may not accommodate pipeline pigging equipment for performing various maintenance operations. In cases where pigging equipment is accommodated, a separate bypass pipeline section has to be installed (or the pump is installed on a bypass section), which further limits deployment flexibility and increases cost.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a fluid processing machine is described. The machine includes: a stator configured to generate a rotating electromagnetic field; and a first rotor section that includes at least one impeller and at least one permanent magnet. The stator is configured to electromagnetically engage with the first rotor section inducing its rotation about a central axis in a first rotational direction thereby causing the impeller(s) to impart kinetic energy on the fluid being processed. According to some embodiments, the machine also includes further rotor sections displaced from the first rotor section and each other along the central axis. Each of the rotor sections include at least one permanent magnet and at least one impeller, and each are configured to electromagnetically engage with the stator and be induced by the stator to rotate about the central axis in the first rotational direction. According to some embodiments, each of the rotor sections is configured to engage at least one thrust bearing to at least partially counteract axial force imparted on the impellers during operation. In some cases each rotor section has its own dedicated thrust bearing that counteracts all of the axial force imparted by the impellers of that rotor section. In other examples some of the imparted axial force its passed through structures and counteracted by another thrust bearing. According to some embodiments, static diffusors are configured to convert at least some of the kinetic energy imparted on the fluid into increased fluid pressure.

According to some embodiments, the stator is external to the first rotor section, and the permanent magnet(s) is located on the outer diameter of the first rotor section. According to some other embodiments, the first stator section is internal to the first rotor section, and the permanent magnet(s) is located on the internal diameter of the first rotor section. An outer casing might be included that surrounds the stator and the first rotor section, and the stator might be canned within a housing that is filled with a liquid. The first rotor section might have a sleeve on its outside diameter configured to contain the permanent magnet(s). The stator might be made up of a plurality of stator sections connected to each other. A passive or active cooling system utilizing the cool surrounding seawater can be included.

According to some embodiments, the permanent magnet (s) are made of material sustaining permanent magnetism. In some cases they might be rare earth magnets such as neodymium magnets and samarium-cobalt magnets. According to some embodiments, the fluid processing machine is a gas compressor, wet gas compressor, single phase compressor, multiphase compressor, gas pump, liquid pump, multiphase pump, single phase pump, or an electric submersible pump. For example, the machine might be an electric submersible pump configured for deployment on a seafloor or in a wellbore. According to some embodiments, the machine can be configured for deployment in a horizontal orientation in-line with a fluid flow line. According to some embodiments, the machine has an area is unoccupied within the machine and the machine is configured to allow for passage of an oilfield service equipment (e.g. a pipeline pig) through the area.

According to some embodiments, the machine can include a second rotor section rotatable about the central axis in a second rotational direction that is opposite to the first rotation direction. In some cases, a second stator can be provided that is configured to generate a rotating electromagnetic field. The second rotor section can include at least one permanent magnet and be configured to electromagnetically engage with the second rotor section inducing it to rotate about the central axis in the second rotational direction. In some other cases, the machine includes a shaft and a separate an electric motor that is configured to drive the shaft and second rotor in the second rotational direction.

According to some embodiments, a system is described that transports fluid produced from at least one well using plurality of the previously described fluid processing machines. According to some embodiments, the well(s) are on a seabed and the system is a subsea system for lifting the produced fluid to a surface facility. One or more heaters can be configured to heat the produced fluid in one or more locations thereby reducing viscosity of the fluid, and resulting in reduced fluid flow friction. According to some embodiments, the plurality of machines might be deployed in locations such as: in-well, integrated into a christmas tree, along a flowline between tree and subsea manifold, or along a flowline between subsea manifold and said surface facility. According to some embodiments, the system might include a first variable speed drive (VSD) that might be located topside in the surface facility, and a second VSD located subsea. In such cases, the subsea fluid processing machines might be driven using a combination of the first and second VSDs. Alternatively, multiple VSD's, all subsea, can be used for the purpose of start-up and/or speed control.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein.

DETAILED DESCRIPTION

The particulars shown herein are by way of example and for purposes of illustrative discussion of the embodiments of the subject disclosure only. In this regard, no attempt is made to show structural details of the present disclosure in more detail than is necessary for the fundamental understanding of the present disclosure, the description taken with the drawings making apparent to those skilled in the art how the several forms of the present disclosure may be embodied in practice. As used herein the term "impellers" refers to any impeller blade, regardless of whether the processed fluid is air, another gas, a mixture of gas and liquid, or a liquid. Further, like reference numbers and designations in the various drawings indicate like elements.

According to some embodiments, a distributed pumping and pipeline heating system is used to optimize production. According to some embodiments, the power infrastructure can be shared by the pumps and heating system. In order to lift hydrocarbons from the seafloor to the surface facilities several pumps and heating systems might be used together. The heating system might be used to reduce frictional losses due to lowering fluid viscosity. Multiple, distributed fluid pumps can be used to increase differential pressure incrementally. Furthermore, a distributed pumping system may be desirable due to constrained sea floor terrain and topography.

The disclosed fluid processing machine, according to some embodiments, when compared to a conventional subsea pumping system is compact, lightweight, and more efficiently and easily fitted to subsea piping. According to some embodiments, the disclosed fluid processing machine is able to accommodate a flowline pig or other equipment to service the well. According to some other embodiments, a flowline pig might be accommodated by using a bypass, in a manner such as used with conventional pumping systems. According to some embodiments, the disclosed fluid processing machine can be integrated part of a subsea christmas tree, and/or located within a wellbore as an electrical submersible pump (ESP).

Figure 1:
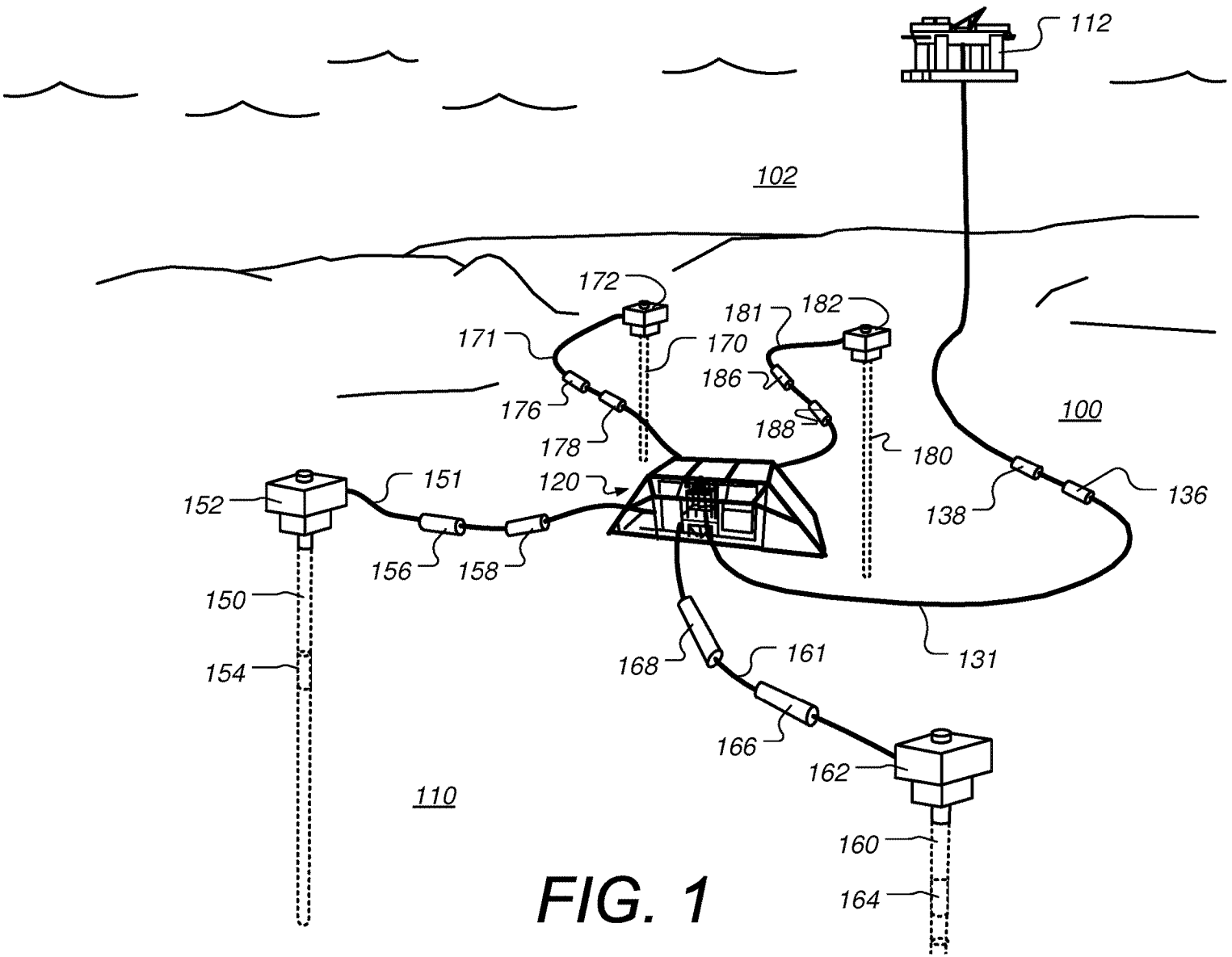
FIG. 1 is a diagram illustrating a subsea environment in which compact motor and pump units can be deployed, according to some embodiments.

FIG. 1 is a diagram illustrating a subsea environment in which disclosed fluid processing machine(s) can be deployed, according to some embodiments. On sea floor 100 a subsea manifold 120 is shown which is downstream of several wells being used in this example to produce hydrocarbon-bearing fluid from a subterranean rock formation. In this simple example, there are four wells 150, 160, 170 and 180 that are producing fluid from rock formation 110. At the sea floor 100, wells 150, 160, 170 and 180 are connected to christmas trees 152, 162, 172 and 182, respectively. According to some embodiments, some or all of the wells contain one or more electric submersible pump (ESP) to aid in producing the produced fluid. In FIG. 1, ESPs 154 and 164 are visible within wells 150 and 160, respectively. According to some embodiments, fluid processing machines like pump units, such as described in further detail herein, are used as ESPs 154 and/or 164. Furthermore, such pump units might also be integrated into one or more of the christmas trees 152, 162, 172 and 182. By being compact, lightweight and easily pipe-fittable, the disclosed fluid processing machines can be integrated in christmas tree configurations where it would have been impractical to deploy conventional subsea pumps.

According to some embodiments, multiple pumps of the disclosure and flowline heating systems are implemented in a subsea infrastructure, making production more efficient and/or increasing overall oil recovery. Unlike some conventional subsea pumps, the pumps according to some embodiments of the disclosure can be mounted horizontally in the same direction as the flowline. The pump of the disclosure can also be fitted to a flowline using horizontal clamping techniques or other common techniques such as welding.

Flowlines (or pipes) 151, 161, 171 and 181 carry produced fluid from wells 150, 160, 170 and 180, respectively, to manifold 120. Flowline 131 then carries the produced fluid from manifold 120 to a surface platform 112 along sea floor 100 through seawater 102. In other cases, other surface facility types can be substituted for platform 112 such as a floating production, storage and offloading unit (FPSO), or a shore-based facility. In cases of relatively long tie back distances from the wells 150, 160, 170 and 180 to manifold 120, several pumps may be applied for each well, and possibly several sections that are heated. In the example of FIG. 1, pump units of the disclosure 156, 166, 176 and 186, and flowline heating units 158, 168, 178 and 188 are installed on flowlines 151, 161, 171 and 181, respectively. In this example, each flowline has one pump unit and one heating unit. Similarly, fluid flow within flowline 131 is aided by compact pump unit 136 and heating unit 138. Note that manifold 120 can also include a pump unit, according to some embodiments. In other examples other numbers of pump and heating units can be used. In some cases, for example heating may not be provided. According to some embodiments, completely insulated piping and/or continuous heated piping (not sections) may be applied. According to some embodiments, the pumping system and heating system may use a common power and control system that is described further with respect to FIG. 2, infra. Although four wells are shown in the example of FIG. 1, other numbers of wells could be connected to manifold 120. Additionally, other manifolds that are connected to other wells can be provided and connected to platform 112 using separate flow lines or through further manifolds.

The distributed system of pumps according to the disclosure (and heating) may provide advantages over conventional subsea systems including: reducing topside and subsea infrastructure, and reducing tie-back cable cost. By supplying power and control to multiple pumps and heating units using a single subsea umbilical cable, large cost savings on cable and installation can be achieved.

Not shown are one or more umbilical cables run from surface platform 112 to supply electric power for the pump units and heating units. According to some embodiments, the one or more umbilicals can also be used to supply bather and other fluids, and control and data lines for various subsea equipment. Further detail of electrical power supply and control is provided with respect to FIG. 2, infra.

Although many embodiments described herein refer to pump units, according to some embodiments, the combined motor and impeller sections can be configured for other subsea fluid processes, such as a compressor and/or a subsea separator. In embodiments described herein, it is understood that references to subsea pumps and pump units can alternatively refer to subsea compressors. Furthermore, references herein to subsea pumps and subsea compressors should be understood to refer equally to subsea pumps and compressors for single phase liquids, single phase gases, or multiphase fluids.

Although the well 150, 160, 170 and 180 have been described as being used to produce hydrocarbon-bearing fluid (such as oil, gas, condensate or combinations thereof) from a subterranean rock formation, according to some embodiments the pump units of the disclosure can be used in connection with other types of wells including: water injection well, water disposal well, and gas injection well.

According to some embodiments, the pump unit and the associated pipelines and equipment are deployed in a topside surface location. For example, in FIG. 1, wells 150, 160, 170 and 180 might be surface and/or transition zone wells, and one or more of the flowlines, pump units and heating units might be surface-deployed. According to some other embodiments, the pumped fluid can be a liquid, such as water (including seawater), a gas, or a multiphase mixture of liquid and gas phases.

Figure 2:
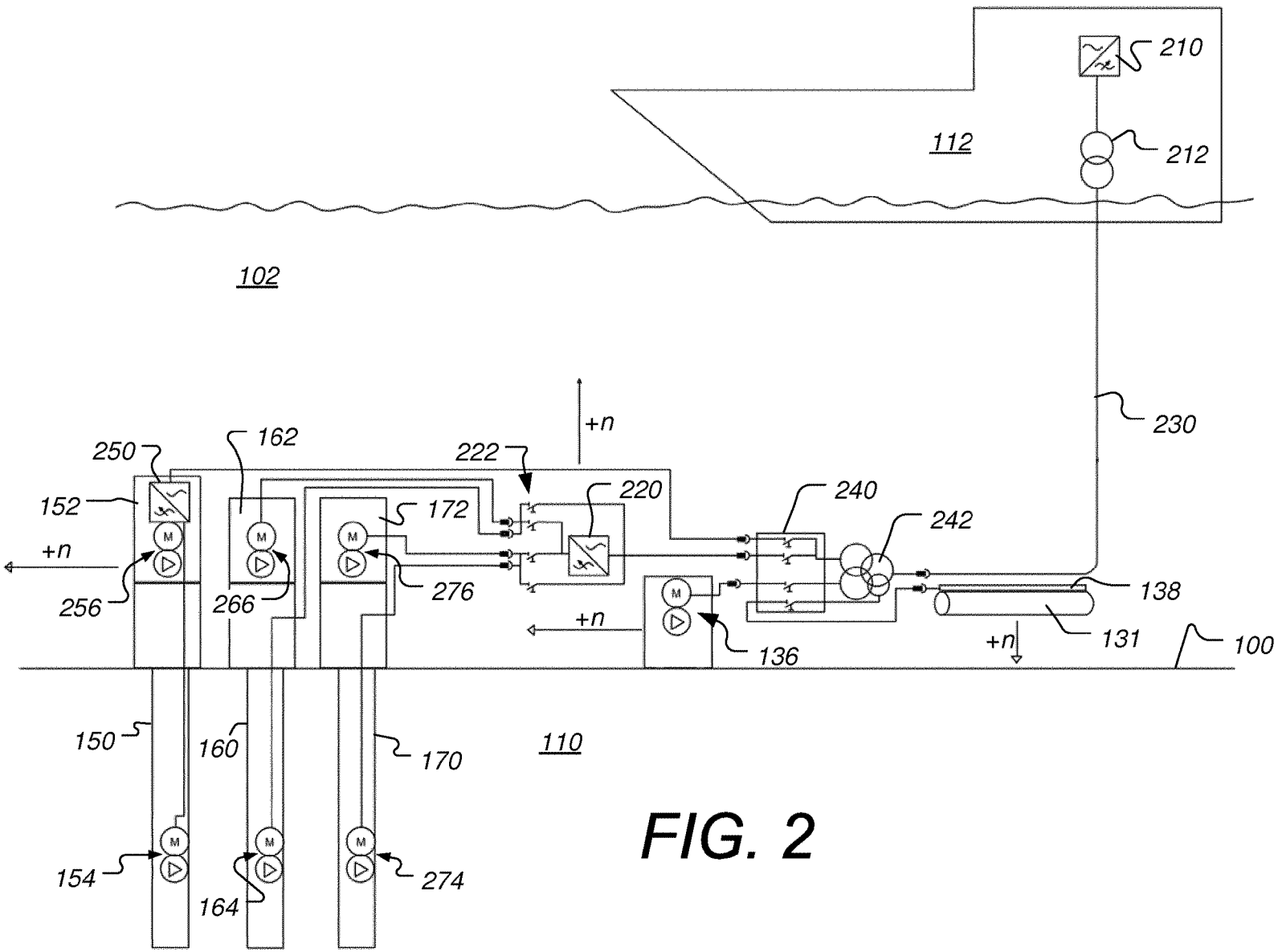
FIG. 2 is schematic diagram illustrating aspects of electrical power supply to a number of compact pump units and other subsea equipment, according to some embodiments.

FIG. 2 is a schematic diagram illustrating aspects of electrical power supply to a number of pump units of the disclosure and other subsea equipment, according to some embodiments. Note that in this example, surface platform 112 is shown as a vessel such as an FPSO. In the surface facility (vessel 112), are a surface variable speed drive (VSD) and a step up transformer 212. The electrical power is transmitted via a single power cable 230 that may include, for example, three conductors transmitting 3-phase power. The cable 230 is connected to a subsea multi-winding transformer 242 that can provide several different step down voltages with galvanic isolation. Using a topside VSD 210 avoids any inrush into step down transformer 242 and also into any of the subsea VSDs, which may have built-in transformers. The topside VSD 212 might also be used to regulate the pipeline heating. An advantage of using a multi-winding transformer 242 is galvanic isolation of the various subsea circuits. Additionally, a separate winding in transformer 242 can be provided for pipeline heater 138, which is providing heating for flowline 131. Providing a separate winding for the heater 138 may be desirable since the heater may use quite different voltage and current values than the pump units. Another separate winding of transformer 242 is provided for pump unit 136, which includes both an electric motor and pump, as shown symbolically. According to some embodiments, the transformer 242 switching unit 240 may be located in a subsea station such as at the location of manifold 120 (shown in FIG. 1). In such cases the power supply lines from switch unit 240 to pump unit 136 and heater 138 can be routed back up along the flowline 131. Note that the "+n" notation in FIG. 2 means that there can be one or more additional similar elements, so there can be multiple additional pump units and/or heaters, according to the needs of the particular application. For example, in some cases multiple pump units may more efficiently move the produced fluid through the flowline 131 to the vessel or platform 112, when compared with conventional systems that employ a single, higher capacity pump located at the subsea manifold. Furthermore, a distributed system may be less prone to catastrophic risk from pump failure than a conventional system. According to some embodiments, the power for heater 138 (and/or compact pump 136) could be provided from a separate power cable coming from the vessel (or platform) 112. An advantage of routing the power from subsea location, such as depicted in FIG. 2, however, is that it saves hanger space, and/or slip rings in the case of swivel on an FPSO, for example. Christmas trees 152, 162, and 172 are shown for wells 150, 160 and 170, respectively. Compact pump units 256, 266 and 276 are shown within christmas trees 152, 162, and 172, respectively. ESPs 154, 164 and 274, which use pump units of the disclosure, are shown within wells 150, 160 and 170, respectively.

According to some embodiments, a dedicated VSD can be provided locally for each well, such as the case for VSD 250 driving compact pump unit 256 in christmas tree 152 and ESP 154. Although two pump units are being run in parallel by a single VSD 250, both pumps are used to produce the same fluid flow. In other cases, a single VSD can be used to drive pumps for multiple wells, such as the case for VSD 220 using switches 222 for driving pumps 164, 266, 274 and 276 in two different wells 160 and 170. Note that sharing a single VSD among multiple pumps may be especially desirable in cases where all the pumps can be driven at the same speed. Sharing a single VSD among multiple wells beneficially reduces the number of subsea VSDs for a given number of wells. According to some embodiments, the subsea VSD can be used for starting the pump and then bypassed. This way, several trees and downhole-pumps can be started with a single subsea VSD. After the bypass is engaged, the pumps will run at same frequency as the other subsea pump units (e.g. pump unit 136), all being driven by topside VSD 210. According to some embodiments, the individual pump unit speeds can be tailored to some degree by varying the pole pair numbers of the electric motor. According to some embodiments, the process can be reversed so that the bypass is removed and speed control is engaged using the subsea VSDs. In general, the number of VSDs used will depend on the complexity of the system and how difficult the wells are to operate. Note that while FIG. 2 shows the electrical power lines and various VSDs, the various control lines for transmitting control signals are not shown, for simplicity.

As mentioned, supra, in a conventional system a single subsea booster pump is often deployed at the seabed (often called mudline pump) typically at a manifold. Thus, the conventional subsea pump may have to cope with the flow from several production wells. This increases the power rating by a typical factor of 5-10 over that of an in-well pump (e.g. an ESP). Thus, implementing a distributed system using several pump units of the disclosure such as shown in FIGS. 1 and 2 can provide significant decreases in cost and/or risk when compared with a conventional system that uses single topside or a single subsea VSD for a single large pump located at the manifold.

Figure 3:
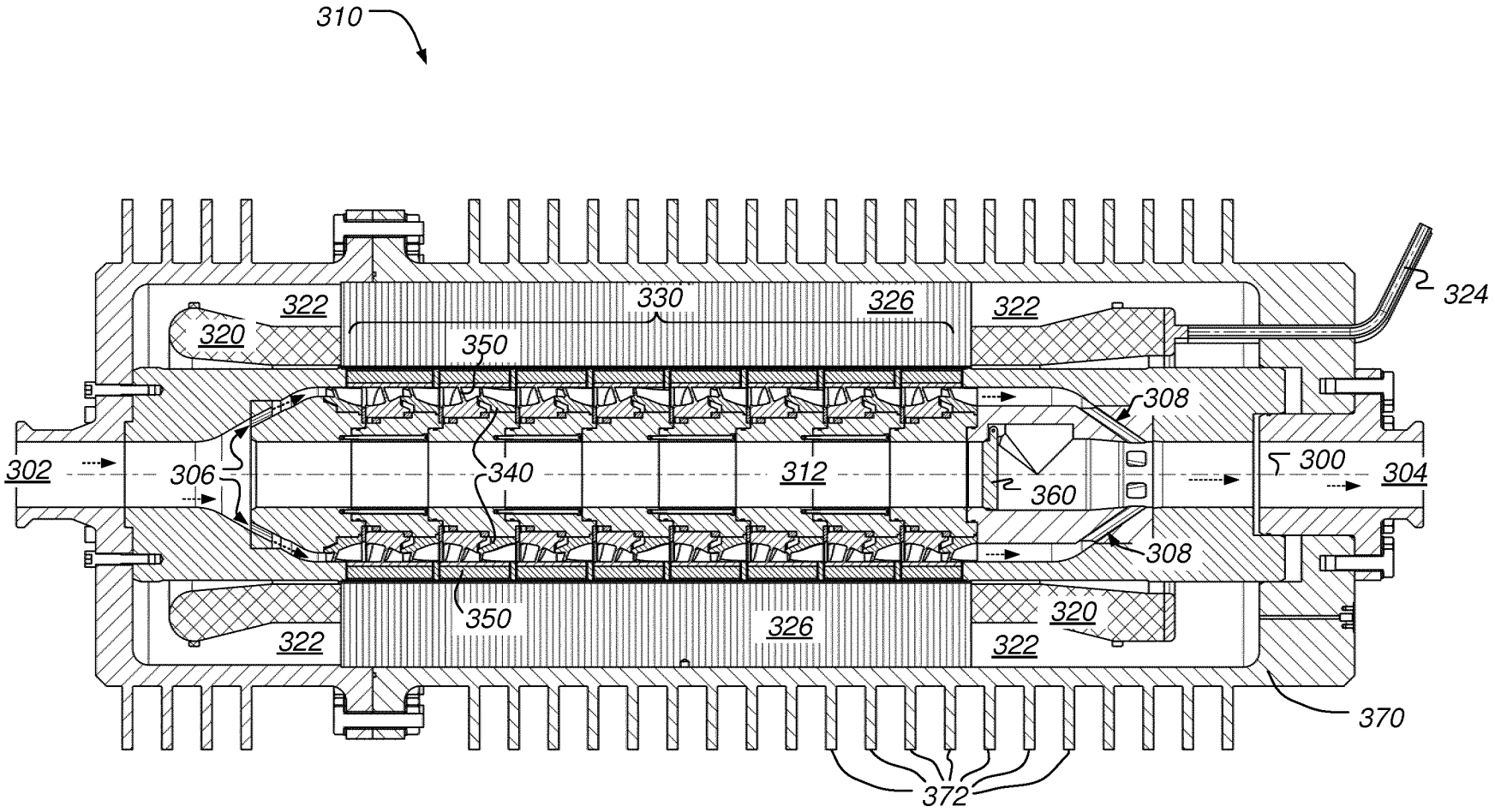
FIG. 3 is a cross section view of a compact pump unit for multiphase fluids, according to some embodiments.

FIG. 3 is a cross section view of a pump unit of the disclosure for multiphase fluids, according to some embodiments. Pump 310 is configured as a multiphase pump that might be used in various subsea and surface applications. According to some embodiments, pump 310 can be used for one or more of the pump units shown and described in FIGS. 1 and 2 including pump units 136, 154, 156, 164, 166, 176, 186, 256, 266, 274 and 276. In example pump 310, the electric motor and pump sections are integrated in compact fashion, rather than being separated by a drive shaft and mechanical coupling(s) as in conventional systems. The pump is enclosed in a casing 370 that according to some embodiments includes a plurality of cooling fins 372. The stator 326 surrounds the rotor, which is made up of a stack of impeller stages in impeller/diffuser stack 330. The stator 326, with stator windings 320, generates a rotating electromagnetic field that induces a rotating movement to the "rotor" or rotating impellers that have permanent magnets mounted thereon. The rotating impellers rotate about a central axis 300 of pump 310. According to some embodiments, the stator is "canned" with volume 322 filled with a liquid such as an insulating oil or bather fluid. Penetrator 324 is included for a three-phase electrical power cable to pass though the casing 370. According to some embodiments other pass-through technology could be used for passing power through the casing 370.

The impeller/diffuser stack 330 includes alternating rotating impellers (such as on impeller assembly 350) and stationary diffusers (such as on diffuser assembly 340). Each impeller increases the kinetic energy and pressure of the multiphase fluid being processed while each diffuser converts the kinetic energy into a further fluid pressure increase. According to some embodiments, the impellers and diffusers are stacked upon one another as will be described in further detail, infra. Pump 310 has an inlet 302 and an outlet 304. Fluid is drawn into the inlet 302 and then through passages or conduits 306, as shown by the dotted arrows. After flowing through the impeller/diffuser stack 330 the fluid exits via conduits 308 to outlet 304. Note that by integrating the motor and pump in the example shown in FIG. 3 there is large central area 312 that is not occupied by a drive shaft as in many conventional pump designs. According to some embodiments, the central area 312 can be used to pass a pipeline pig, or other servicing tool, through the pump 310 when the pump is not running. According to some embodiments, a check valve 360 is shown that might be in a closed position, such as depicted in FIG. 3, when the pump 310 is operating. This is because during pump operation the fluid pressure at the outlet 304 might be higher than at the inlet 302. When the pump is not operating, however, the inlet pressure might be higher than, or nearly equal to, the outlet pressure, and the check valve moves to the open position. Alternatively, the check valve 360 can be operated by an actuator (not shown). An actuated valve may also be desirable in some applications, such as: (1) a means of control where pumps are run at a constant speed (rpm); and (2) where difficult start-up conditions exist.

In the open position the check valve 360 and central area 312 allow, for example, for a pipeline pig to pass through the pump 310.

According to some embodiments, the stator section might be cooled passively by the surrounding seawater and cooling fins 372. According to some other embodiments, the stator might include active cooling wherein a special or single impeller (not shown) might achieve circulation. Alternatively, at least one magnet on at least one rotor section can induce a magnet on the other side of the stator skin (i.e. within volume 322), in a magnet coupling principle, and set up cooling for an element, by a small impeller on the stator side for example. In some embodiments, cooling might be made by cooling fluid such as monoethylene glycol (MEG) or a dielectric fluid.

Figure 4:
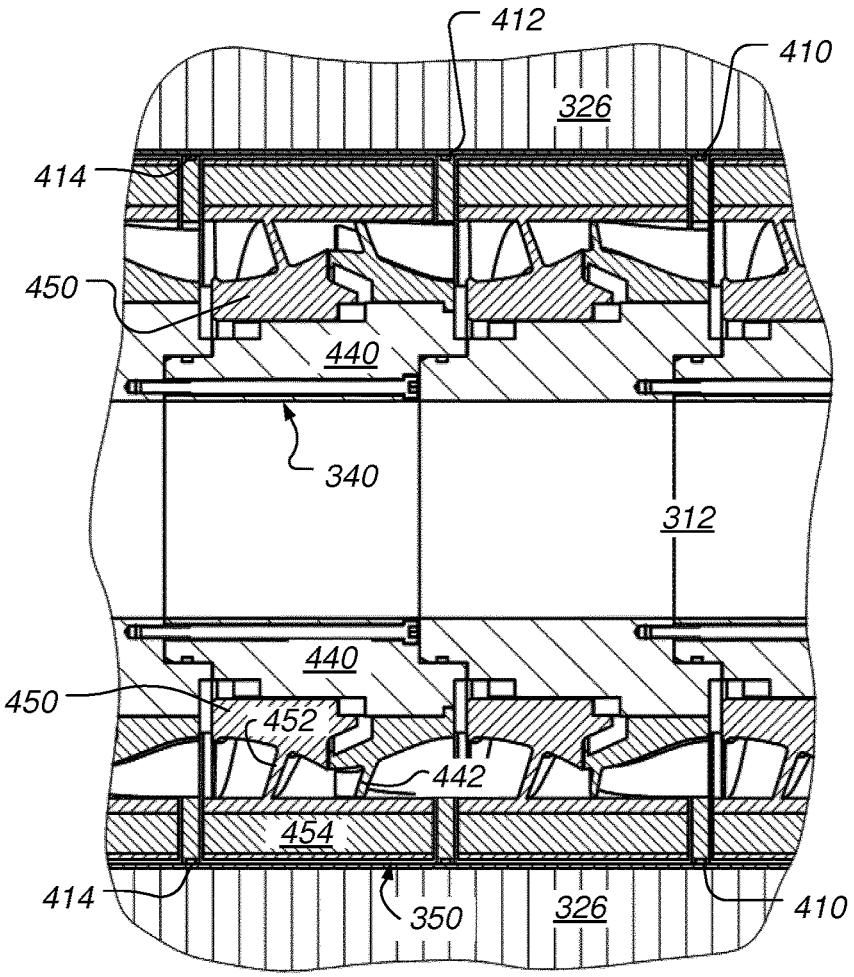
FIG. 4 is cross section view illustrating further detail of a portion of the impeller/diffuser stack of a compact pump unit for multiphase fluids, according to some embodiments.

FIG. 4 is a cross section view illustrating further detail of a portion of the impeller/diffuser stack of a pump unit for multiphase fluids, according to some embodiments of the disclosure. As can be seen, the diffuser assembly 340 includes a hub body 440 and a diffuser element 442 that is shaped so as to convert the fluid velocity into pressure. Rotor body 450 is a metallic rotor piece, part of which is formed into impeller element 452. The rotating impeller assembly 350 includes permanent magnets 454 around the outer surface of rotor body 450. Impeller element 452 is shaped to increase kinetic energy and pressure of the fluid. According to some embodiments, multiple impeller elements 452 are included in rotor body 450. According to some embodiments, permanent magnets 454 are attached to rotor body 450 using glue or some other adhesive, or welding. According to some other embodiments, magnets 454 are inserted into slots formed into rotor body 450. Between each of the stages might be interstage seals, such as interstage seals 410, 412 and 414. The interstage seals provide a degree of pressure isolation between the successive stages as well as limit the radial pressure exerted between the rotating impellers and the stator.

Figure 5:
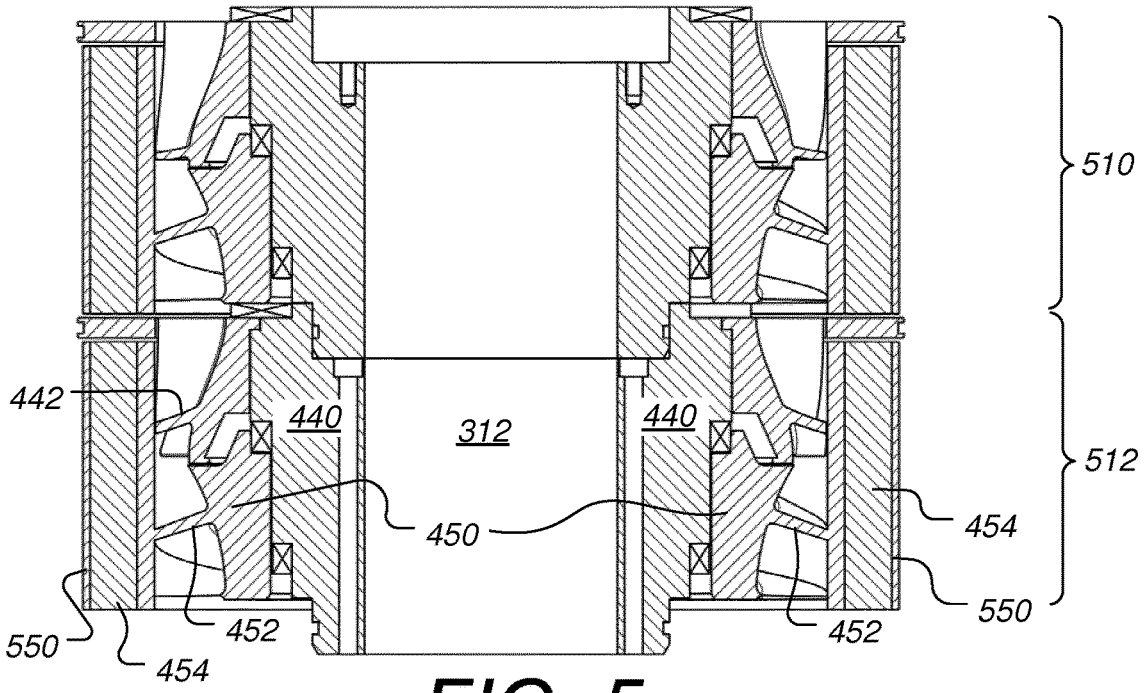
FIG. 5 is a cross section view illustrating further detail of a portion of the impeller/diffuser stack of a compact pump unit for multiphase fluids, according to some embodiments.

FIG. 5 is a cross section view illustrating further detail of a portion of the impeller/diffuser stack of a pump unit for multiphase fluids, according to some embodiments of the disclosure. Visible are two impeller/diffusers pairs 510 and 512 that are "stacked" upon one another. According to some embodiments, the stacking arrangement of impellers and diffusers provide ease of assembly and other benefits. Also visible in FIG. 5 is magnet containment member 550 that surrounds, contains and protects permanent magnets 454.

Figure 6A:
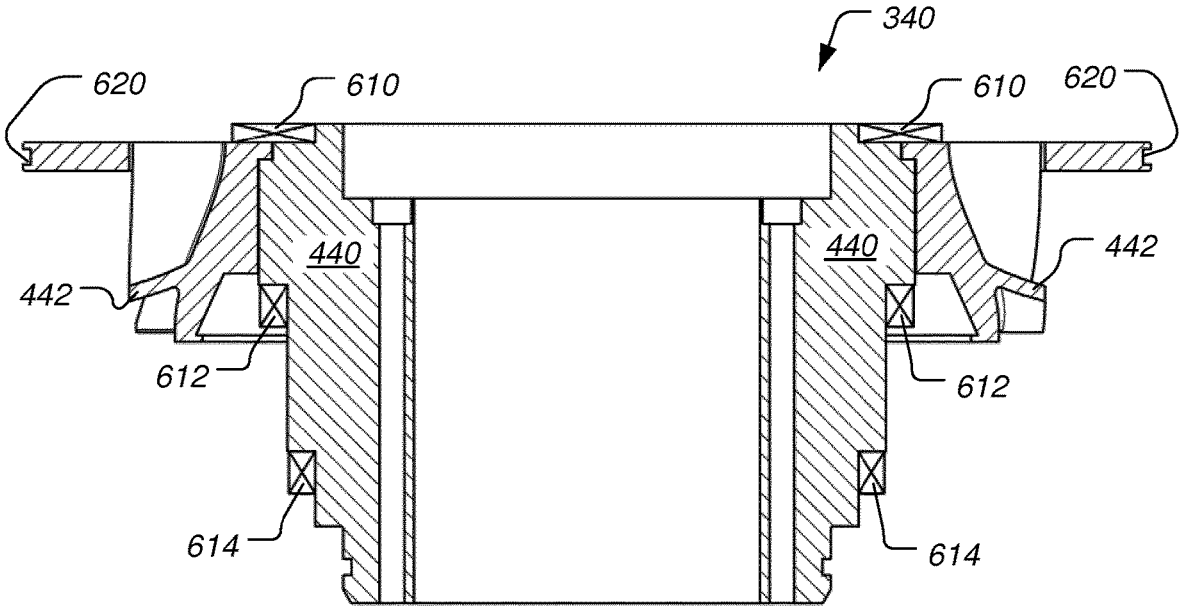
FIGS. 6A and 6B are cross section views of a diffuser assembly and an impeller assembly, respectively, of a compact pump unit for multiphase fluids, according to some embodiments.
Figure 6B:
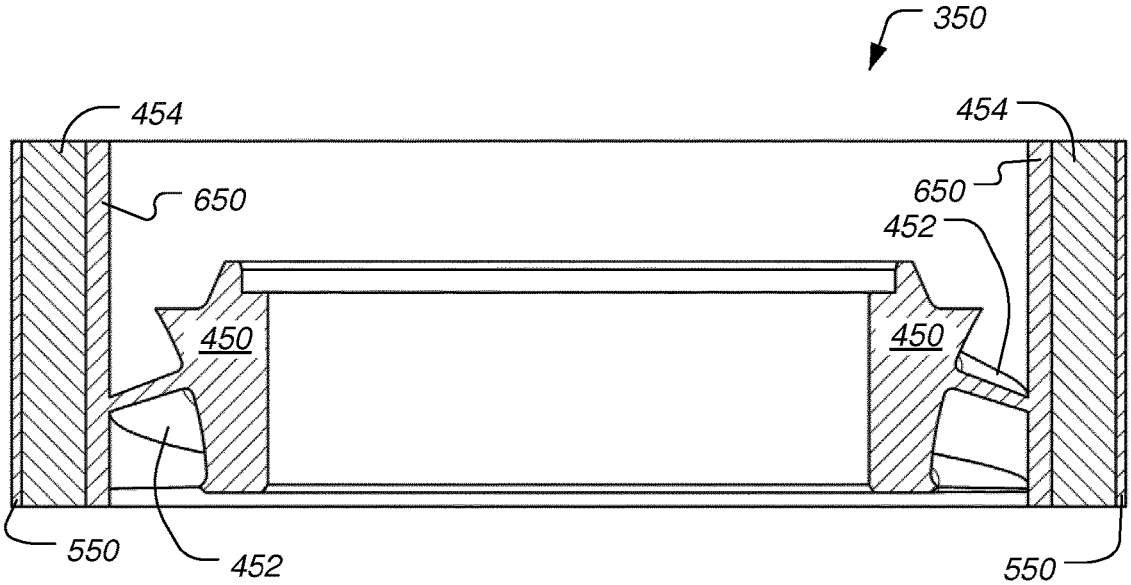

FIGS. 6A and 6B are cross section views of a diffuser assembly and an impeller assembly, respectively, of a pump unit for multiphase fluids, according to some embodiments of the disclosure. In FIG. 6A, axial or thrust bearing 610 and two radial bearings 612 and 614 are visible. The bearings might be lubricated by, for example and without limitation, (regenerated) monoethylene glycol (MEG), or other fluids coming from the bather side for internal cleanliness and bearing operation. In embodiments wherein the fluid processing machine is a water injection pump, the water itself might be the lubricant material. Alternatively, thrust or other bearings might contain diamond coating, ceramics, etc., and/or might be lubricated by the process fluid. By providing a thrust bearing 610 between each impeller and diffuser assembly, smaller thrust forces can be handled incrementally, and the use of larger thrust disks might be avoided. According to some embodiments, a conventional thrust disk might be provided to carry the axial load of some or all of the impeller stages. Additionally, a conventional separate bather fluid circuit might be provided to supply lubrication to some or all of the bearings. In embodiments, sand protection means might be provided to the axial and radial bearings. According to some embodiments, other types of bearing technology might be implemented. Examples include, not limitatively: magnetic bearings, chemical injection bearings, and diamond coated bearing surfaces. In one example, process fluid lubrication of the bearings is supplemented by injecting chemicals in certain locations in order to improve the environment for the bearings and other mechanical components with small clearances. Also visible in FIG. 6A is groove 620 for the interstage seal 412 shown in FIG. 4, supra.

Referring to FIG. 6B, according to some embodiments, magnet containment member 550 might be transparent to electrical fields whilst maintaining the permanent magnets 454 contained due to centrifugal forces. According to some embodiments, member 550 might be made of woven carbon fibers, Kevlar, glass in an epoxy resin, or a thermoplastic material. According to some embodiments, the rotor body 450 might comprise wear resistant coatings in locations where radial bearings 612 and 614 and/or thrust bearing 610 interfaces with rotor body 450.

Figure 11:
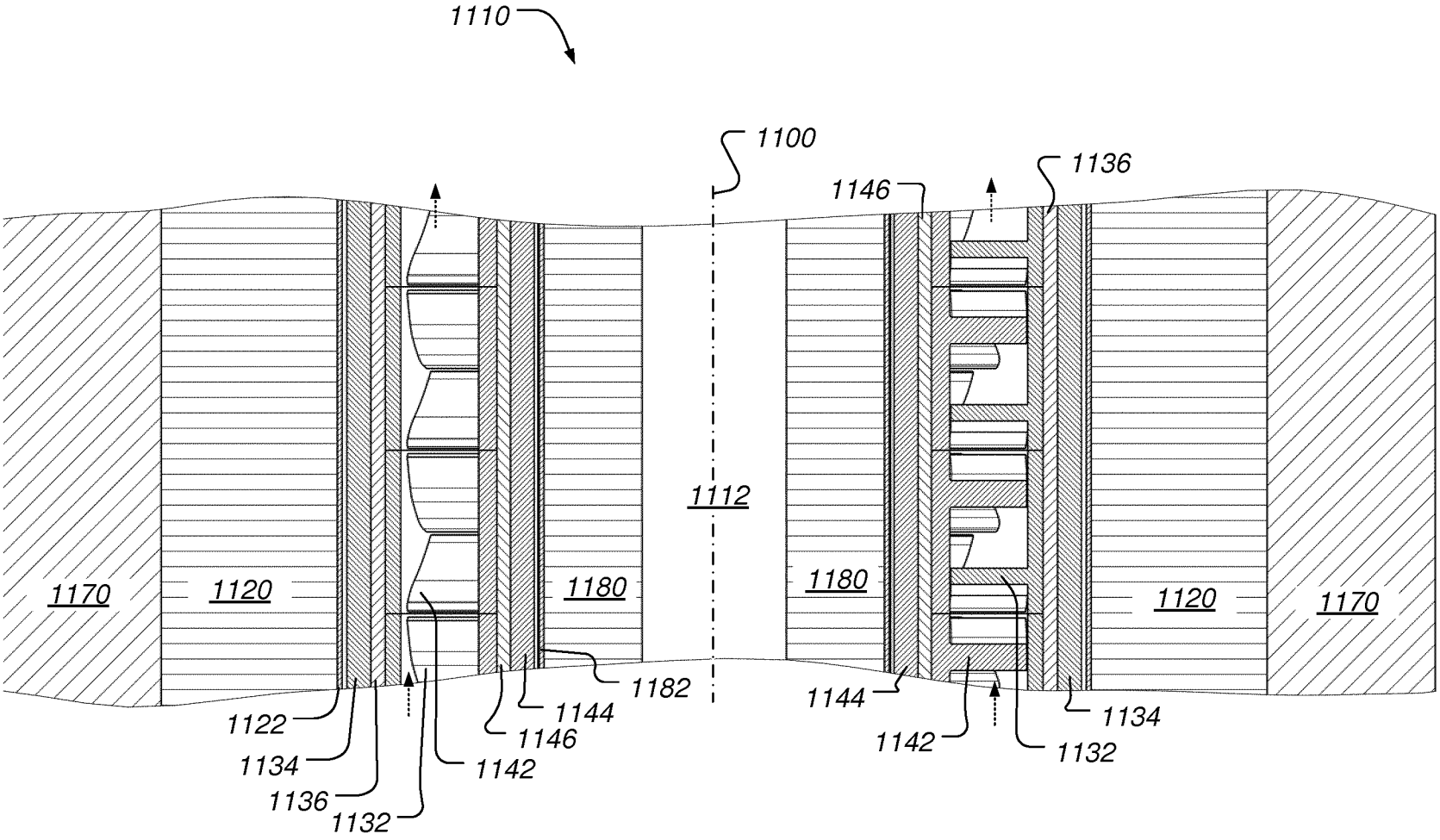
FIG. 11 is a cross section view illustrating aspects of a contra-rotating compact compressor, according to some embodiments.
Figure 12:
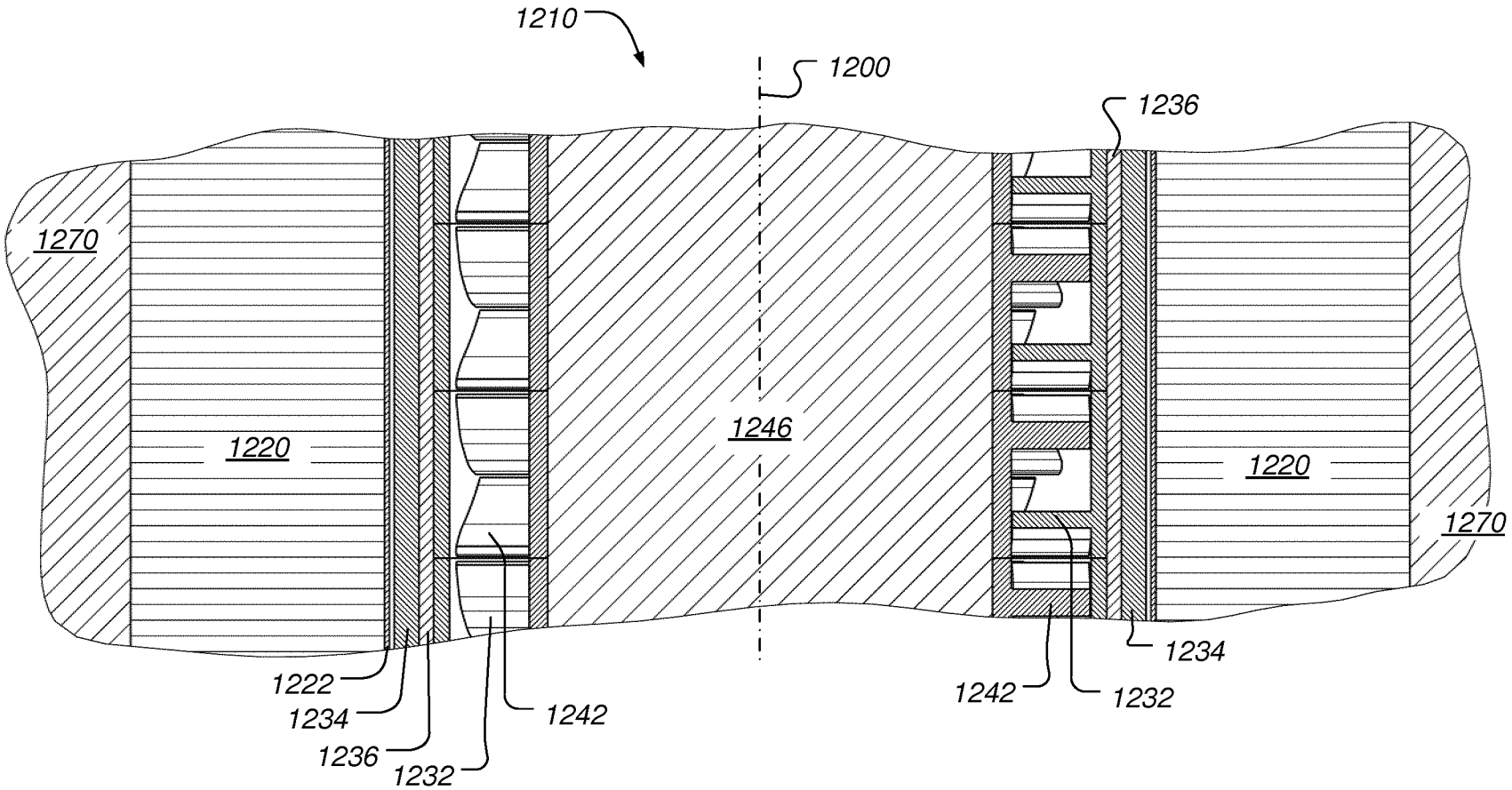
FIG. 12 is a cross section view illustrating aspects of a contra-rotating compact compressor, according to some alternative embodiments.

According to some embodiments, part of rotor body 450 might be formed into sleeve portion 650. Sleeve portion 650 supports (or contains) the permanent magnets 454 and reduces or avoids impeller losses and/or flow regime interference from impeller stage to impeller stage. Impeller induced swirling on the impeller outside diameter may be reduced, creating increased performance. Other phenomena in relation to flow-induced interference (from one impeller stage to the next impeller stage, for example) may hence also be reduced. According to some embodiments, the blade shape of impeller element 452 is cylindrical (i.e. the shape does not change along the radial direction). In some embodiments, however, the impeller element 452 is non-cylindrical in that its shape changes in the radial direction. Note that in general, impeller elements 452 can be any style or shape, including without limitation centrifugal impeller, single rotating, or contra-rotating (such as shown in FIGS. 11 and 12, infra).

Figure 7:
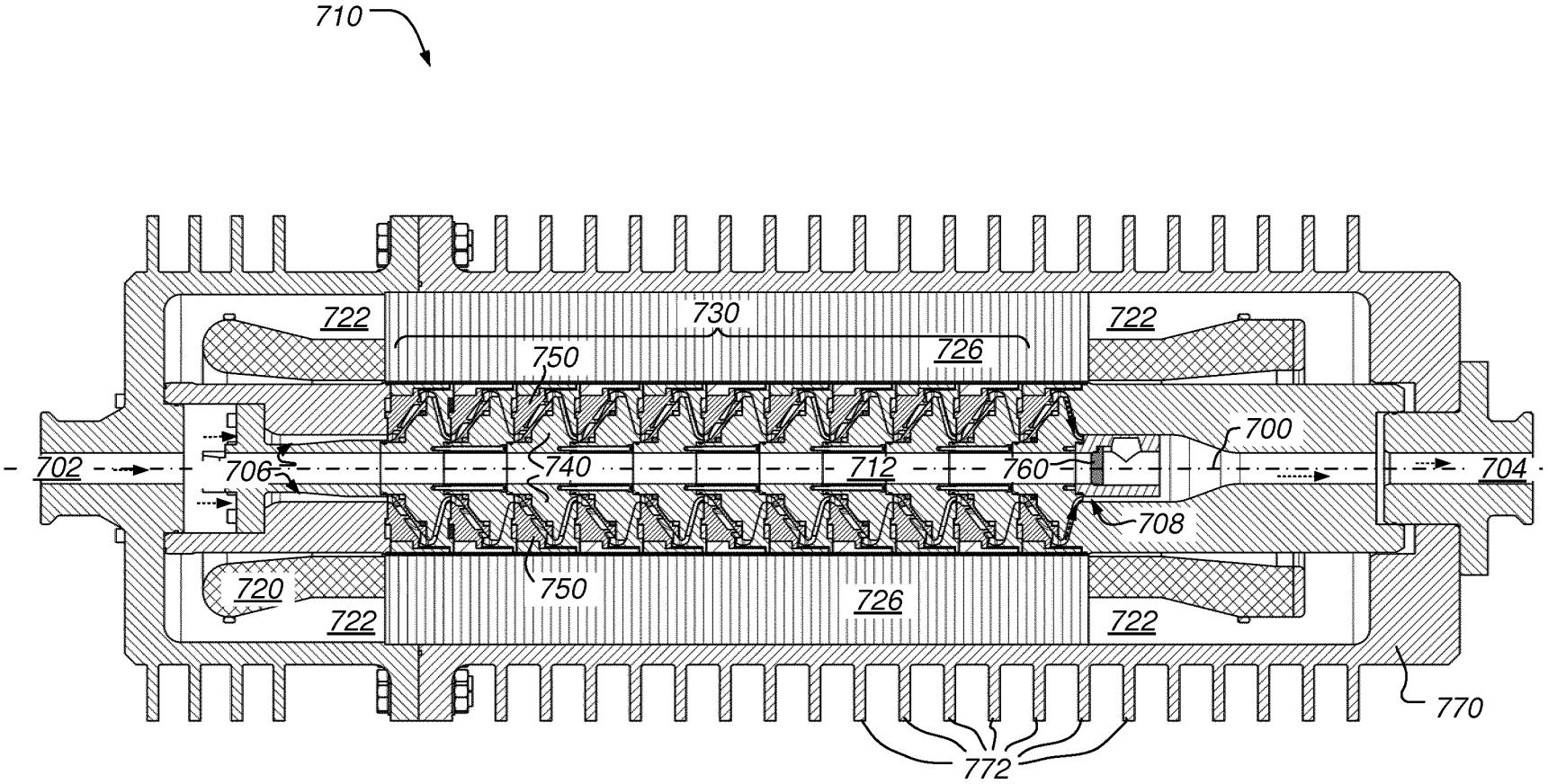
FIG. 7 is a cross section view of a compact pump unit for single phase fluids, according to some embodiments.

FIG. 7 is a cross section view of a pump unit for single phase fluids, according to some embodiments of the disclosure. Pump 710 is configured as a single phase pump that might be used in various subsea and surface applications. According to some embodiments, pump 710 can be used for one or more of the pump units shown and described in FIGS. 1 and 2, including pump units 136, 154, 156, 164, 166, 176, 186, 256, 266, 274 and 276. As in pump 310 shown in FIG. 3, supra, pump 710 integrates an electric motor and pump sections in compact fashion, rather than being separated by a drive shaft as in conventional systems. The pump is enclosed in a casing 770 that according to some embodiments includes a plurality of cooling fins 772. The stator 726 surrounds the rotor, which is made up of a stack of impeller stages in impeller/diffuser stack 730. The stator 726, with stator windings 720, generates a rotating electromagnetic field that induces a rotating movement to the "rotor" or rotating impellers that have a permanent magnet mounted thereon. The rotating impellers rotate about a central axis 700 of pump 710. According to some embodiments, the stator is "canned" with volume 722 filled with a liquid such as an insulating oil or barrier fluid.

The impeller/diffuser stack 730 includes alternating rotating impellers (such as on impeller assembly 750) and stationary diffusers (such as on diffuser assembly 740). Each impeller increases the kinetic energy and pressure of the single phase fluid being processed, while each diffuser converts the kinetic energy into a further fluid pressure increase. According to some embodiments, the impellers and diffusers might be stacked upon on another as will be described in further detail, infra. Pump 710 has an inlet 702 and an outlet 704. Fluid is drawn into the inlet 702 and then through passages or conduits 706, as shown by the dotted arrows. After flowing through the impeller/diffuser stack 730, the fluid exits via conduits 708 to outlet 704. Note that by integrating the motor and pump in the example shown in FIG. 7 there is large central area 712 that is not occupied by a drive shaft as in many conventional pump designs. According to some embodiments, the central area 712 can be used to pass a servicing equipment such as, but not limited to, a pipeline pig through the pump 710 when the pump is not running. Shown is a check valve 760 that might be in a closed position such as depicted in FIG. 7 when the pump 710 is operating. When the pump is not operating, the check valve 760 moves to the open position, allowing passage of a pipeline pig through pump 760.

According to some embodiments, the stator section might be passively cooled by the surrounding seawater and cooling fins 772. According to some other embodiments, the stator might be actively cooled such as described with respect to FIG. 3, supra.

Figure 8:
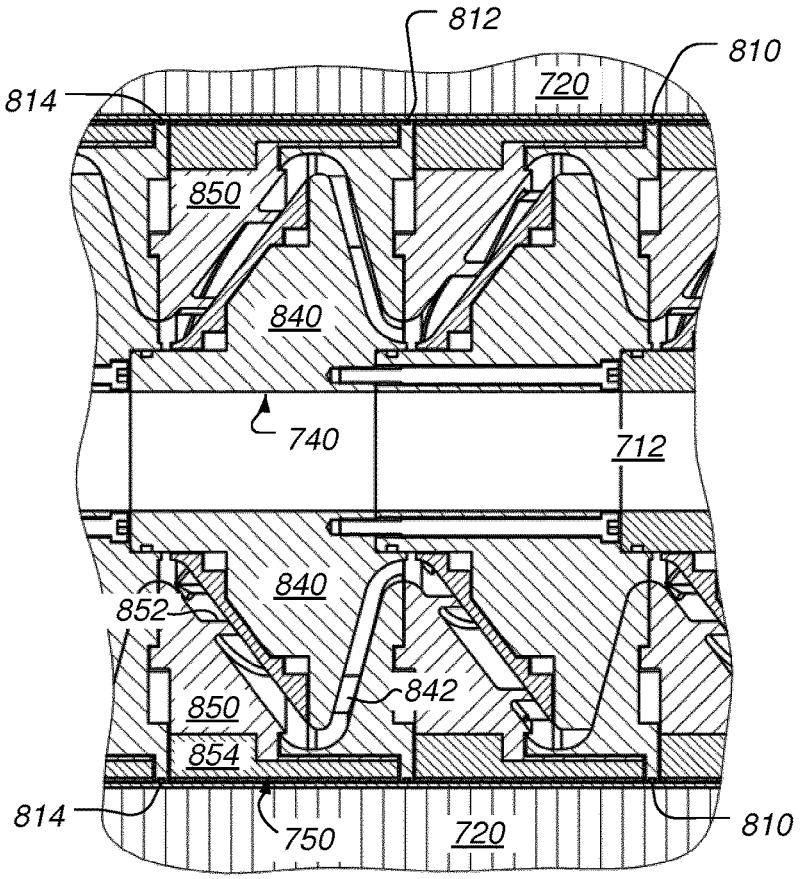
FIG. 8 is cross section view illustrating further detail of a portion of the impeller/diffuser stack of a compact pump unit for single phase fluids, according to some embodiments.

FIG. 8 is cross section view illustrating further detail of a portion of the impeller/diffuser stack of a pump unit for single phase fluids, according to some embodiments of the disclosure. As can be seen, the diffuser assembly 740 includes a hub body 840 and a diffuser element 842 that is shaped so as to convert the fluid velocity into pressure. The rotating impeller assembly 750 includes permanent magnets 854 around its outer surface and rotor body 850. Magnets 854 can be adhered or inserted into slots as discussed supra with respect to magnets 454. Impeller element 852 might be shaped to increase kinetic energy and pressure of the fluid.

According to some embodiments, multiple impeller elements 852 are included in rotor body 850. Between each of the stages might be interstage seals, such as interstage seals 810, 812 and 814. The interstage seals provide a degree of pressure isolation between the successive stages as well as limit the radial pressure exerted between the rotating impellers and the stator.

Figure 9:
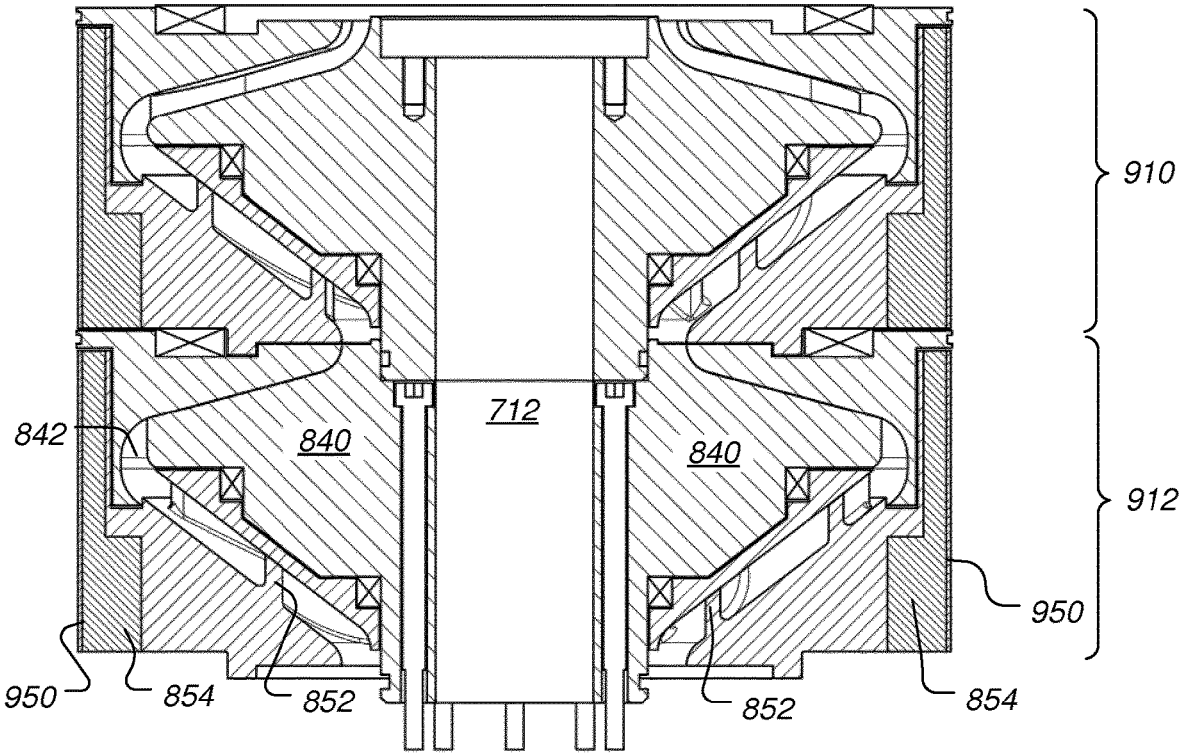
FIG. 9 is a cross section view illustrating further detail of a portion of the impeller/diffuser stack of a compact pump unit for single phase fluids, according to some embodiments.

FIG. 9 is a cross section view illustrating further detail of a portion of the impeller/diffuser stack of a compact pump unit for single phase fluids, according to some embodiments of the disclosure. Visible are two impeller/diffusers pairs 910 and 912 that are "stacked" upon one another. According to some embodiments, the stacking arrangement of impellers and diffusers provide ease of assembly and other benefits. Also visible in FIG. 9 is magnet containment member 950 that surrounds, contains and protects permanent magnets 854. According to some embodiments, permanent magnets 854 might change thickness along the axial direction as shown, which allows more radial space for the impellers and diffusers while maintaining overall compactness of the pump unit. According to some other embodiments, the magnets 854 might be constant thickness along the axial direction such as magnets 454 shown in FIGS. 4, 5 and 6B, supra.

Figure 10A:
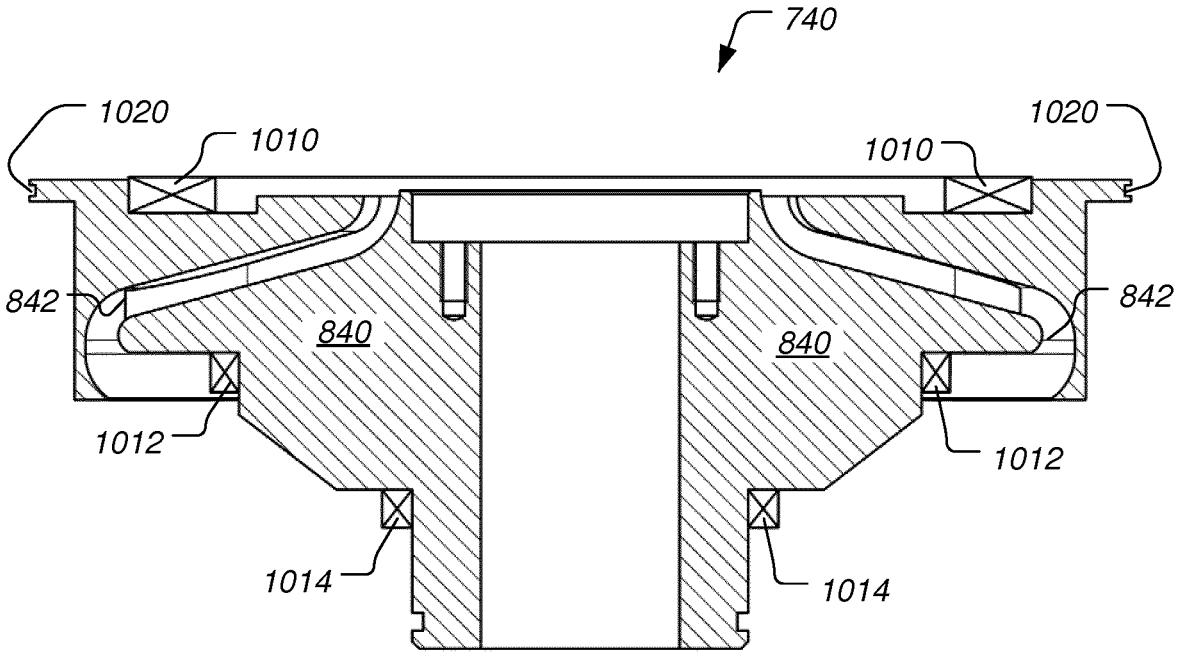
FIGS. 10A and 10B are cross section views of a diffuser assembly and an impeller assembly, respectively, of a compact pump unit for single phase fluids, according to some embodiments.
Figure 10B:
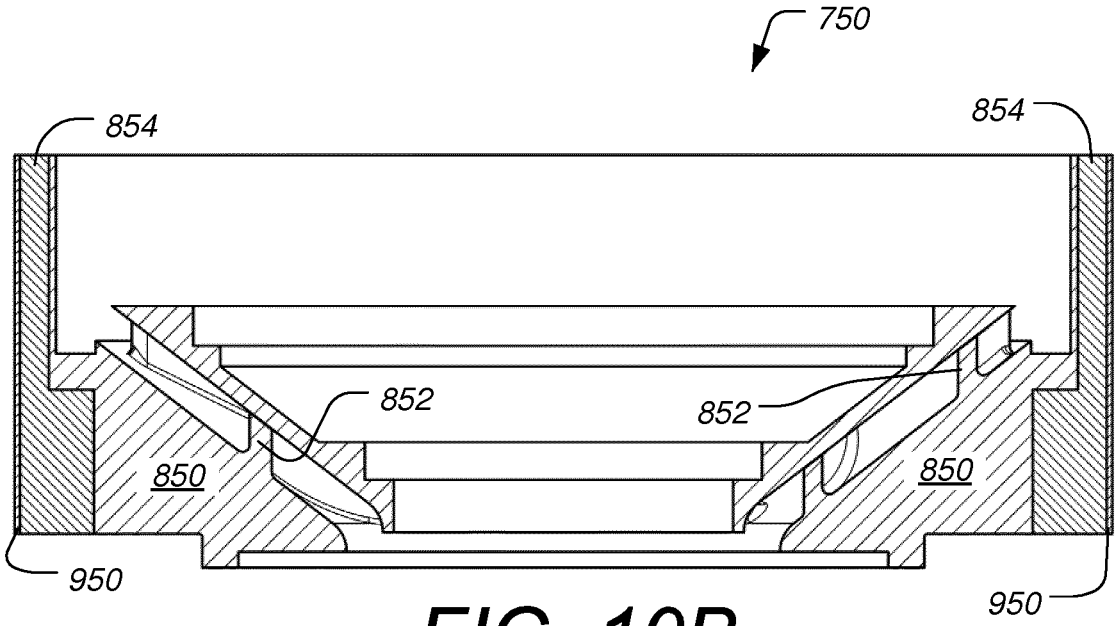

FIGS. 10A and 10B are cross section views of a diffuser assembly and an impeller assembly, respectively, of a pump unit for single phase fluids, according to some embodiments. In FIG. 10A, axial or thrust bearing 1010 and two radial bearings 1012 and 1014 are visible. The bearings might be lubricated, for example and without limitation, by (regenerated) monoethylene glycol (MEG), or other fluids coming from the bather side for internal cleanliness and bearing operation. In embodiments wherein the fluid processing machine is a water injection pump, the water itself might be the lubricant material. By providing a thrust bearing 1010 between each impeller and diffuser assembly, smaller thrust forces are handled incrementally, and the use of larger thrust disks might be avoided. Alternate bearing arrangements and technology can be employed, such as discussed supra with respect to FIG. 6A. Also visible in FIG. 10A is groove 1020 for the interstage seal 812 shown in FIG. 8, supra.

Referring to FIG. 10B, according to some embodiments, magnet containment member 950 might be transparent to electrical fields whilst maintaining the permanent magnets 854 contained due to centrifugal forces. According to some embodiments, member 950 might be made of woven carbon fibers, Kevlar, glass in an epoxy resin, or a thermoplastic material.

FIG. 11 is a cross section view illustrating aspects of a contra-rotating compressor, according to some embodiments of the disclosure. Contra-rotating compressor 1110 is configured as a wet gas compressor that might be used in various subsea and surface applications. According to some embodiments, compressor 1110 can be used in place of one or more of the compact pump units shown in FIGS. 1 and 2. As in the case of pumps 310 and 710 described supra, compressor 1110 integrates an electric motor and impeller sections in a compact faction. With known contra-rotating wet gas compressors, two interleaved sets of impellers are driven opposite (or contra-rotating) directions using two separate electric motors that are longitudinally offset from the impellers by relatively long shafts or a combination of a sleeve and shaft. In contrast, compressor 1110 of the disclosure integrates both electric motors with the impellers having permanent magnets mounted thereon. Compressor 1110 might include an outer stator, an inner stator and two sets impeller sleeves disposed between the two stators that are driven in opposite directions by the two stators. On the outer portion of compressor 1110 is the outer casing 1170, outer stator winding 1120 and outer stator canning member 1122. Near the outer stator winding 1120 are outer permanent magnets 1134 that are fixed to an outer sleeve member 1136. A plurality of outer impellers 1132 are fixed to the outer sleeve member 1136. An inner stator 1180 might be canned with inner stator canning member 1182. Close to the inner stator windings 1180 are inner permanent magnets 1144 that are fixed to inner sleeve member 1146 and inner impellers 1142. The outer stator winding 1120 generates a rotating electromagnetic field that induces a rotating movement in the magnets 1134, outer sleeve member 1136 and outer impellers 1132 about a central axis 1100. In a similar fashion, an inner stator winding 1180 generates a rotating electromagnetic field that induces a rotating movement in the magnets 1144, inner sleeve member 1146 and inner impellers 1142. The outer and inner impellers are driven in opposite, or contra-rotating, directions. Note that in this example there remains an open central area 1112 that can accommodate, for example, passage of a pipeline pig during times when the compressor is not operating. According to some embodiments, the contra-rotating compressor 1110 includes shielding means (not shown) for electromagnetic effects between each rotor section.

FIG. 12 is a cross section view illustrating aspects of a contra-rotating compressor, according to some alternative embodiments of the disclosure. Contra-rotating compressor 1210 is configured as a wet gas compressor that might be used in various subsea and surface applications. Compressor 1210 is similar to compressor 1110 shown in FIG. 11, except that the inner impellers 1242 are fixed to a central shaft 1246 that is driven by an electric motor (not shown) that is longitudinally offset either above or below the impeller sections. The outer casing 1270, stator winding 1220, canning 1222, permanent magnets 1234, sleeve member 1236 and outer impellers 1232 are similar or identical to those of FIG. 11. In this sense, the compressor 1210 is type of "hybrid" design in that it combines a compact integrated electric motor to drive the outer impellers with a conventional, shaft-offset electric motor to drive the inner impellers.

According to some embodiments, the compressor such as shown in FIGS. 11 and 12 might be a hybrid, but having a central stator and permanent magnet driven inner impellers, such as shown in FIG. 11, combined with outer impellers and a sleeve that is driven conventionally with a shaft and longitudinally offset electric motor. According to some embodiments, a variation of the compact pumps shown in FIGS. 3 and 7 are driven by an internal central stator, such as shown in FIG. 12, that drive inner impellers that are interleaved with static diffusers.

According to some embodiments, flexibility can be provided in speed (i.e. revolutions per minute (RPM)) range and/or in dimensions for the pumps or compressors. Further, the pumps and compressors described herein allow for flexibility in terms of number of rotor sections and/or impeller stages. For example, in FIG. 3 there are eight pairs of stacked impellers and diffusers shown. However, the number of impeller/diffuser pairs can be modified to greater or lesser numbers, depending upon the particular application. According to some other embodiments, a pump of the disclosure is provided by including a number of multiphase stages such as shown in FIG. 3, followed by a number of single phase stages such as shown in FIG. 7.

According to some other embodiments, pump or compressor can be configured to allow different rotational speeds (RPMs) on different impeller stages within the same pump unit. This can be accomplished, for example by altering the number of poles in the stator and rotor section for different impeller stages. This could also be accomplished by varying the number, arrangement and/or polarity of the permanent magnets on the impeller-rotor.

According to some embodiments, the available cross section for an impeller is relatively high as the machine does not need a shaft to drive the impellers and/or a lubrication circuit might not be needed. According to some embodiments, the mechanical effects between impeller steps might be avoided because each impeller is electromechanically driven, and the plurality of impeller stages are not mechanically connected.

According to some other embodiments, the impeller stages may form a converging cross sectional flow area. For example, this might be achieved by reducing outside diameter sequentially per impeller stage from the pump or compressor inlet to the outlet. Alternatively, this might also be achieved by using progressively more material in the center of the impeller for each successive impeller stage (like step-shaped a cone).

While the subject disclosure is described through the above embodiments, it will be understood by those of ordinary skill in the art that modification to and variation of the illustrated embodiments may be made without departing from the inventive concepts herein disclosed. Moreover, while some embodiments are described in connection with various illustrative structures, one skilled in the art will recognize that the system may be embodied using a variety of specific structures.

What is claimed is:

1. A fluid processing machine comprising:

a first stator configured to generate a rotating electromagnetic field;

a first rotor section comprising at least one first impeller and at least one first permanent magnet, wherein the first stator is configured to electromagnetically engage with the first rotor section inducing rotation of the first rotor section about a central axis in a first rotational direction thereby causing the at least one first impeller to impart kinetic energy on a fluid being processed;

a second rotor section rotatable about the central axis in a second rotational direction opposite to the first rotational direction, the second rotor section comprising a second impeller;

a shaft in mechanical communication with the second rotor section; and an electric motor longitudinally displaced from the first and second rotor sections and configured to drive the shaft and the second rotor in the second rotational direction.

2. The machine of claim 1, comprising a plurality of further rotor sections displaced from the first rotor section and along the central axis, each further rotor section comprising at least one permanent magnet and at least one impeller, each further rotor section being configured to electromagnetically engage with the first stator and be induced by the first stator to rotate about the central axis in the first rotational direction.

3. The machine of claim 1 or 2, further comprising a plurality of thrust bearings, wherein each of the first and plurality of further rotor sections is configured to engage at least one of the thrust bearings to at least partially counteract axial force imparted by the at least one first impeller of the first rotor section during operation.

4. The machine of claim 1, further comprising a plurality of static diffusors configured to convert at least some of the kinetic energy imparted on the fluid into increased fluid pressure.

5. The machine of claim 1, wherein the first stator is external to the first rotor section, and the at least one permanent magnet is located on the outer diameter of the first rotor section.

6. The machine of claim 1, wherein the first stator is internal to the first rotor section, and the at least one permanent magnet is located on the internal diameter of the first rotor section.

7. The machine of claim 1, further comprising an outer casing surrounding the first stator and the first rotor section, and wherein the first stator is canned within a housing that is filled with a liquid.

8. The machine of claim 1, wherein the first rotor section has a sleeve on its outside diameter configured to contain the at least one permanent magnet.

9. The machine of claim 1, wherein the first stator comprises a plurality of stator sections connected to each other.

10. The machine of claim 1, further comprising a cooling system using seawater.

11. The machine of claim 1, wherein the fluid processing machine is of at least one type selected from a group consisting of: gas compressor, wet gas compressor, single phase compressor, multiphase compressor, gas pump, liquid pump, multiphase pump, single phase pump, and electric submersible pump.

12. The machine of claim 1, wherein the fluid processing machine is an electric submersible pump configured for deployment on a seafloor or in a wellbore.

13. The machine according to claim 12, wherein the machine is configured for deployment in a horizontal orientation in-line with a fluid flow line.

14. The machine according to claim 12, wherein an area is unoccupied within the machine and the machine is configured to allow for passage of an oilfield service equipment through the area.

15. The machine of claim 1, wherein the fluid processing machine is a water injection pump.

16. The machine of claim 1, further comprising a second stator configured to generate a rotating electromagnetic field, wherein the second rotor section further comprises at least one permanent magnet, and the second stator is configured to electromagnetically engage with the second rotor section inducing rotation of the second rotor section about the central axis in the second rotational direction.

17. A system for transporting fluid produced from at least one well using at least one fluid processing machine according to claim 1 to aid in said transporting.

18. The system of claim 17, wherein the at least one well is on a seabed and the system is a subsea system for lifting the produced fluid to a surface facility.

19. The system of claim 17, further comprising one or more heaters configured to heat the produced fluid in one or more locations thereby reducing viscosity of the fluid.

20. The system of claim 18, comprising a plurality of the fluid processing machine wherein said plurality of fluid processing machines are deployed in locations selected from a group consisting of: in-well; on a christmas tree; along a flowline between a tree and a subsea manifold; and along a flowline between a subsea manifold and said surface facility.

21. The system of claim 18, further comprising:

a first Variable Speed Drive (VSD) located topside in the surface facility; and a second VSD located subsea, wherein the plurality of machines are driven using a combination of the first and second VSDs.

* * * * *